US007955769B2

(12) United States Patent
Black et al.

(10) Patent No.: US 7,955,769 B2
(45) **Date of Patent: *Jun. 7, 2011**

(54) CONTROL OF CRAZING, CRACKING OR CRYSTALLIZATION OF A CHARGE TRANSPORT LAYER IN A PHOTOCONDUCTOR

(75) Inventors: David Glenn Black, Longmont, CO (US); James Alan Hartman, Broomfield, CO (US); Ronald Harold Levin, Lafayette, CO (US); Weimei Luo, Louisville, CO (US); Dat Quoc Nguyen, Platteville, CO (US); Tanya Yvonne Thames, Aurora, CO (US)

(73) Assignee: Lexmark International, Inc., Lexington, KY (US)

( * ) Notice: Subject to any disclaimer, the term of this patent is extended or adjusted under 35 U.S.C. 154(b) by 644 days.

This patent is subject to a terminal disclaimer.

(21) Appl. No.: 12/029,752

(22) Filed: Feb. 12, 2008

(65) Prior Publication Data

US 2009/0202928 A1 Aug. 13, 2009

(51) Int. Cl.
*G03G 5/047* (2006.01)

(52) U.S. Cl. ..... 430/58.8; 430/58.05; 430/59.6

(58) Field of Classification Search ..... 430/58.8, 430/58.05, 59.6, 59.5; 399/159
See application file for complete search history.

(56) References Cited

U.S. PATENT DOCUMENTS

| | | | | |
|---|---|---|---|---|
| 5,413,886 | A | 5/1995 | Pai et al. | |
| 5,415,962 | A | 5/1995 | Kanemaru et al. | |
| 6,183,921 | B1 | 2/2001 | Yu et al. | |
| 6,376,143 | B1 | 4/2002 | Neely et al. | |
| 7,037,630 | B2 | 5/2006 | Vong et al. | |
| 7,642,027 | B2 * | 1/2010 | Hartman et al. | 430/58.05 |
| 2008/0076051 | A1 * | 3/2008 | Hartman et al. | 430/58.05 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 388-394.*

Diamond, Arthur S & David Weiss (eds.) Handbook of Imaging Materials, 2nd ed.. New York: Marcel-Dekker, Inc. (Nov. 2001) pp. 401-403.*

* cited by examiner

*Primary Examiner* — Christopher RoDee

(57) ABSTRACT

Embodiments of a photoconductor for use in a printer or printer cartridge comprise an electrically conductive substrate, a charge generation layer disposed over the electrically conductive substrate, and a charge transport layer disposed over the charge generation layer, wherein the charge transport layer comprises charge transport molecules with octyl/decyl glycidyl ether (OGE) or dodecyl/tetradecyl glycidyl ether (DGE), or combinations thereof, added to improve resistance to crazing, cracking and crystallization in the change transport layer.

15 Claims, 3 Drawing Sheets

CONTROL OF CRAZING, CRACKING OR CRYSTALLIZATION OF A CHARGE TRANSPORT LAYER IN A PHOTOCONDUCTOR

CROSS REFERENCES TO RELATED APPLICATIONS

This patent application is related to the U.S. patent application Ser. No. 11/535,735, filed Sep. 27, 2006, entitled "CONTROL OF CRAZING, CRACKING OR CRYSTALLIZATION OF A CHARGE TRANSPORT LAYER IN A PHOTOCONDUCTOR " and U.S. patent application Ser. No. 11/144,307, filed Jun. 3, 2005, entitled "PLASTICIZED PHOTOCONDUCTOR," both assigned to the assignee of the present application.

STATEMENT REGARDING FEDERALLY SPONSORED RESEARCH OR DEVELOPMENT

None.

REFERENCE TO SEQUENTIAL LISTING, ETC.

None

BACKGROUND

1. Field of the Invention

Embodiments of the present invention are directed to photoconductors, and are specifically directed to photoconductors comprising dodecyl/tetradecyl glycidyl ether (DGE), octyl/decyl glycidyl ether (OGE), or combinations thereof in the charge transport layer, wherein the OGE or DGE are added to improve resistance to crazing, cracking and crystallization in the charge transport layer.

2. Description of the Related Art

A laminate photoconductor consists of a charge generation layer (CGL) and a charge transport layer (CTL) typically with the CTL as the outer layer. A CTL usually is comprised of a hole transport material and a polymer binder. The surface of a photoconductor is required to be smooth and free of any cracking/crazing lines in order to produce good quality prints. However, the integrity of a photoconductor surface can be destroyed or damaged by the touch of a human hand in some cases, which can result in CTL crazing/cracking. Within a solvent-coated charge transport layer, internal stress can build up during the drying process. As a result of this stress, cracking or so-called crazing in a charge transport layer may occur when the surface is touched by a human hand or finger, or contacted with certain chemicals. These cracking or crazing lines are permanent and cause print defects. The photoconductor is found either in a printer or a printer cartridge depending on the design of the printing system.

The sensitivity of a layered photoreceptor depends on all layers involved, including the charge generation and the charge transport layers. In a charge transport layer, the mobility of a charge transport molecule and the travel distance of a carrier are critical to the discharge of a photoreceptor. Increasing the concentration of charge transport molecule usually results in lowered discharge. However, depending on the structure of the binder and the charge transport molecule, crystallization may occur if the concentration of the charge transport molecule is increased beyond a certain point. Crystallization results in increased residual discharge and image defects, both of which are undesirable.

One approach to address the issue of CTL crazing/cracking and crystallization is to selectively use specific charge transport molecules, or a mixture. Some charge transport molecules inherently have superior CTL crazing/cracking resistance and a low tendency towards crystallization. For example, a charge transport layer containing p-(diethylamino)benzaldehyde diphenylhydrazone (DEH) at various loadings exhibits superior crazing/cracking resistance. Some fluorene derivatives also exhibit excellent cracking resistance and have little tendency to crystallize when formulated in a charge transport layer. Other conventional charge transport layers comprise mixtures of two or more types of charge transporting small molecules such as diamines (e.g. commonly used TPD), triphenylamines and triphenyl methanes. Crazing or cracking of the charge transport layer is effectively eliminated as a result.

Another common approach to enhance crazing/cracking resistance is to dope additive(s) into the charge transport layer. A commonly used additive for such purposes is a plasticizer, for example, diethyl phthalate or branched aliphatic esters. Also, benzotriazole and a branched hydrocarbon have been utilized in the charge transport layer to improve crazing/cracking performance. However, using additives may degrade the electrical and mechanical performance of the photoconductor.

Accordingly, there is a need for improved photoconductors comprising charge transport layer with additives operable to control crazing, cracking or crystallization in the charge transport layer while maintaining the electrical and mechanical properties of the photoconductor.

SUMMARY

In accordance with one embodiment, a photoconductor is provided. The photoconductor comprises an electrically conductive substrate, a charge generation layer disposed over the electrically conductive substrate, and a charge transport layer disposed over the charge generation layer, wherein the charge transport layer comprises charge transport molecules and octyl/decyl glycidyl ether (OGE), dodecyl/ tetradecyl glycidyl ether (DGE), or combinations thereof.

BRIEF DESCRIPTION OF THE DRAWINGS

The following detailed description of specific embodiments of the present invention can be best understood when read in conjunction with the drawings enclosed herewith wherein.

Figure 1:
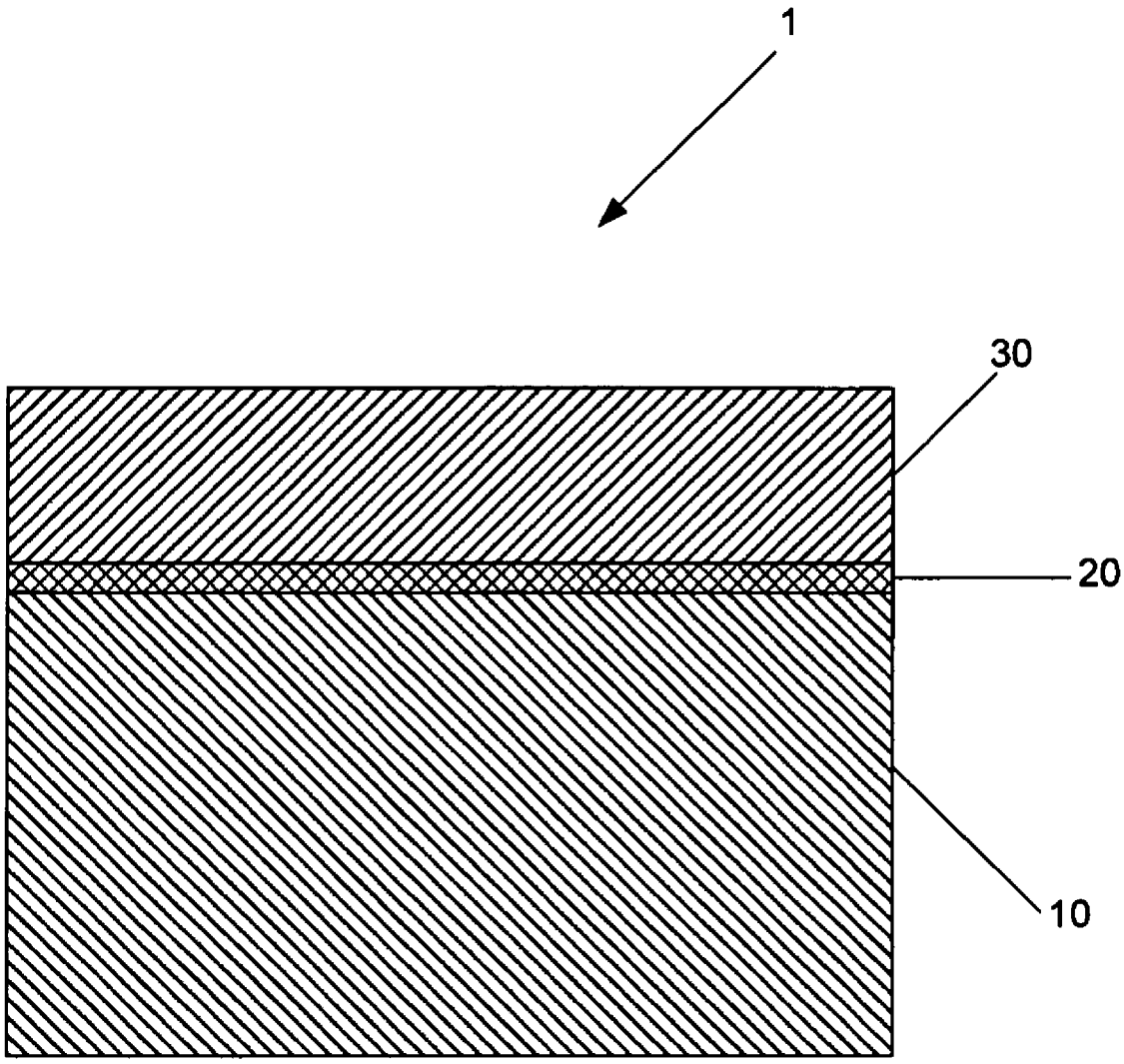
FIG. 1 is a schematic cross sectional view of a photoconductor according to one or more embodiments of the present invention.

The embodiments set forth in the drawings are illustrative in nature and not intended to be limiting of the invention defined by the claims. Moreover, individual features of the invention will be more fully apparent and understood in view of the detailed description, in conjunction with the drawing.

DETAILED DESCRIPTION

Referring to FIG. 1, embodiments of the present invention are directed to a photoconductor 1 comprising an electrically conductive substrate 10, a charge generation layer 20 disposed over the electrically conductive substrate 10, and a charge transport layer 30 disposed over the charge generation layer 20. As used herein, "over" may mean one layer is directly on another layer, or may also allow for intervening layers therebetween. The charge generation layer 20 typically is comprised of a pigment, which is dispersed evenly in one or more types of binders before coating. According to the present invention, the charge transport layer 30 is comprised of one or more charge transport molecules, binder, and additives directed to reducing crazing, cracking and crystallization. The additives may be comprised of octyl/decyl glycidyl ether (OGE), dodecyl/tetradecyl glycidyl ether (DGE), or combinations thereof. Other suitable additives are also contemplated herein. As shown in the structure below, OGE is a mixture of octyl (C8) glycidyl ether and decyl (C 10) glycidyl ether.

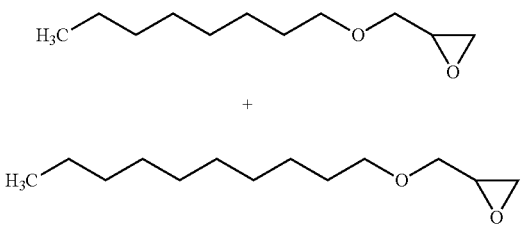

Similarly, DGE is a mixture of dodecyl (C12) glycidyl ether and tetradecyl (C14) glycidyl ether. The charge transport layer may also include charge transport molecules such as N,N'-bis(3-methylphenyl)-N,N'-diphenylbenzidine (TPD). The charge transport formulation may also include (possibly inside a polymeric binder), vinyl polymers such as polyvinylchloride, polyvinylbutyral, polyvinylacetate, styrene polymers and copolymers of the vinyl polymers, acrylic acid and acrylic polymers and copolymers, polycarbonate polymers and copolymers, including polycarbonate-A, which is derived from bisphenol-A, polycarbonate-Z, which is derived from cyclohexylidene bisphenol, polycarbonate-C, which is derived from methylbisphenol-A, polyesters, alkyd resin, polyamides, polyurethanes, polysiloxane, epoxy resins or mixtures thereof and the like. In an exemplary embodiment, a trace amount (<1% by weight) of polysiloxane may also be added to reduce coating defects. TPD has the structure below:

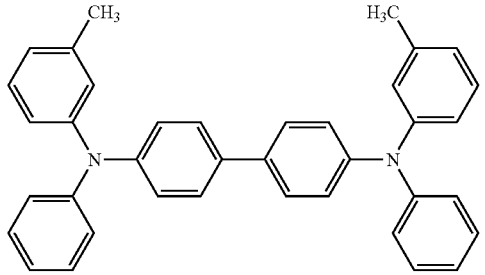

N,N′-Bis(3-methylphenyl)-N,N′-diphenylbenzidine (TPD)

Other charge transport molecules, in addition to TPD, are contemplated herein. For example, and not by way of limitation, the charge transport molecules may be comprised of pyrazoline, fluorene derivatives, oxadiazole transport molecules such as 2,5-bis(4-diethylaminophenyl)-1,3,4-oxadiazole, imidazole, and triazole, hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone). Other suitable hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthalene-1-carbaldehyde 1-methyl-_1-phenylhydrazone, carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, derivatives of aminobenzaldehydes, cinnamic esters or hydroxylated benzaldehydes. Diamine and triarylamine transport molecules such as N,N-diphenyl-N,N-bis(alkylphenyl)-[1,1'-biphenyl]-4,4'-diamines wherein the alkyl is, for example, methyl, ethyl, propyl, n-butyl, or the like, or halogen substituted derivatives thereof, commonly referred to as benzidine and substituted benzidine compounds, and the like are also contemplated herein. Typical triarylamines include, for example, tritolylamine, and the like.

The charge transport layer 30 may also comprise organic solvents selected from the group consisting of tetrahydrofuran and 1,4-dioxane. Other organic solvents are contemplated herein. In an exemplary embodiment, the charge transport layer 30 may comprise about 30 to about 40% by weight (TPD), and about 3 to about 5% by weight OGE.

In yet another exemplary embodiment, the charge transport layer 30 may comprise about 30 to about 40% by weight (TPD), and about 3 to about 5% by weight DGE. The charge transport layer 30 may comprise a thickness of between about 20 to about 30 μm, or other suitable thicknesses familiar to one of ordinary skill in the art.

Referring to FIG. 1, the electrically conductive substrate 10 comprises an electrically conductive metal based material. The substrate 10 may be flexible, for example in the form of a flexible web or a belt, or inflexible, for example in the form of a drum. Typically, the photoconductor substrate is uniformly coated with a thin layer of metal, preferably aluminum which functions as an electrical ground plane. In one embodiment, the electrically conductive substrate 10 comprises an anodized and sealed aluminum core. Alternatively, the ground plane member may comprise a metallic plate formed, for example, from aluminum or nickel, a metal drum or foil, or plastic film on which aluminum, tin oxide, indium oxide or the like is vacuum deposited. Typically, the substrate 10 will have a thickness adequate to provide the required mechanical stability. For example, flexible web substrates generally have a thickness of from about 0.01 to about 0.1 microns, while drum substrates generally have a thickness of from about 0.75 mm to about 1 mm.

The charge generation layer 20 comprises a phthalocyanine compound, for example, titanyl phthalocyanine (IV) dispersed in a binder. Other suitable phthalocyanine compounds may include both metal-free forms such as the X-form metal-free phthalocyanines and the metal-containing phthalocyanines. The binder may comprise polyvinylbutyral, poly(methyl-phenyl)siloxane, polyhydroxystyrene, phenolic novolac, or combinations thereof. One suitable polyvinyl butyral composition is BX-1 produced by Sekisui Chemical Co. Additionally, the charge generation layer 20 may also comprise organic solvents selected from the group consisting of 2-butanone and cyclohexanone. The charge generation layer 20 may comprise a thickness of about 0.1 to about 1 μm, preferably 0.2 to about 0.3 μm. Moreover, the charge generation layer 20 may comprise a mean pigment particle size between about 100 to about 200 nm.

EXAMPLES

To demonstrate the improved properties of the photoconductors comprising charge transport layers (CTL) with OGE or DGE, the following experimental examples are provided. All CTL formulations listed below are evaluated using the test method described below.

Formulations

The charge generation dispersion consists of titanyl phthalocyanine (type IV), polyvinylbutyral, poly(methyl-phenyl) siloxane and polyhydroxystyrene in a ratio of 45/27.5/24.75/2.75 in a mixture of 2-butanone and cyclohexanone. The charge generation dispersion was dip-coated on aluminum substrate and dried at 100° C. for 15 minutes to give a thickness less than 1 μm, and more preferably, 0.2-0.3 μm.

A charge transport formulation (CTL) was prepared by dissolving N,N'-bis(3-methylphenyl)-N,N'-diphenylbenzidine (TPD), polycarbonate A or a combination of polycarbonate A and Z in a mixed solvent of tetrahydrofuran and 1,4-dioxane. A small quantity (<0.01%) of polysiloxane was also added to reduce coating defects of the charge transport layer. The charge transport layer was coated on top of the charge generation layer and cured at 100° C. for 1 hour to give a thickness of 26-27 μm. The compositional amounts of the charge transport formulations studied in the examples are detailed in the Tables 1-3 below:

TABLE 1

5% OGE in TPD-containing charge transport layer (weights in grams)

| Ingredient | 30% TPD Control | % solids | 30% TPD + 5% OGE | % solids | 40% TPD Control | % solids | 40% TPD + 5% OGE | solids % |
|---|---|---|---|---|---|---|---|---|
| THF | 300 | na | 300 | na | 300 | na | 300 | na |
| 1,4-dioxane | 100 | na | 100 | na | 100 | na | 100 | na |
| PC-A | 72.2 | 70 | 73.0 | 65 | 66.7 | 60 | 66.7 | 55 |
| TPD | 30.9 | 30 | 33.7 | 30 | 44.5 | 40 | 48.5 | 40 |
| OGE | 0 | 0 | 5.62 | 5 | 0 | 0 | 6.06 | 5 |

TABLE 2

3 and 5% DGE in 38% TPD-containing charge transport layer (weights in grams)

| Ingredient | 0% DGE (Control) | % solids | 3% DGE | % solids | 5% DGE | % solids |
|---|---|---|---|---|---|---|
| THF | 300 | na | 300 | na | 300 | na |
| 1,4-dioxane | 100 | na | 100 | na | 100 | na |
| PC-A | 48.7 | 46.5 | 47.7 | 44.25 | 46.9 | 42.75 |
| PCZ-400 | 16.2 | 15.5 | 15.9 | 14.75 | 15.6 | 14.25 |
| TPD | 39.8 | 38 | 41 | 38 | 41.6 | 38 |
| DGE | 0 | 0 | 3.24 | 3 | 5.48 | 5 |

TABLE 3

5% DGE in TPD-containing charge transport layer (weights in grams)

| Ingredient | 0% DGE (30% TPD Control) | % solids | 30% TPD + 5% DGE | % solids | 0% DGE (40% TPD Control) | % solids | 40% TPD + 5% DGE | % solids |
|---|---|---|---|---|---|---|---|---|
| THF | 300 | na | 300 | na | 300 | na | 300 | na |
| 1,4-dioxane | 100 | na | 100 | na | 100 | na | 100 | na |
| PC-A | 71.3 | 70 | 71.2 | 65 | 66.7 | 60 | 66.7 | 55 |
| TPD | 30.6 | 30 | 32.9 | 30 | 44.5 | 40 | 48.5 | 40 |
| DGE | 0 | 0 | 5.48 | 5 | 0 | 0 | 6.06 | 5 |

Test Method

The effect of additives (OGE and DGE) to the charge transport layer on the crazing/cracking and crystallization properties of the photoconductors was evaluated, along with the electrical properties including photo-induced decay (PID). Photo-induced decay was determined by charging the photoconductor surface and measuring the discharge voltage as a function of laser (780 nm) energy. The CTL crazing/cracking test was conducted by placing fingerprints (thumb print or "TP" in the data tables) or lotion drops (lotion or "L" in the data tables) directly on the drum surface. The drums with fingerprints and lotion drops were then placed in an oven pre-set at 60° C. The CTL crazing or cracking was monitored by visual inspection. The drums that passed the visual test were then examined under a microscope (up to 1000× magnification). If CTL cracking or crazing lines are seen, the formulation is considered to "fail". If no CTL cracking or crazing lines are seen, then the formulation is considered to "pass". In Table 4 and Table 5, "Y" is for the positive test where crazing lines are seen and "N" is for the negative test where crazing lines are not seen. The test length is 14 days at 60° C. followed by 14 days at ambient conditions.

Results and Conclusions

Figure 2:
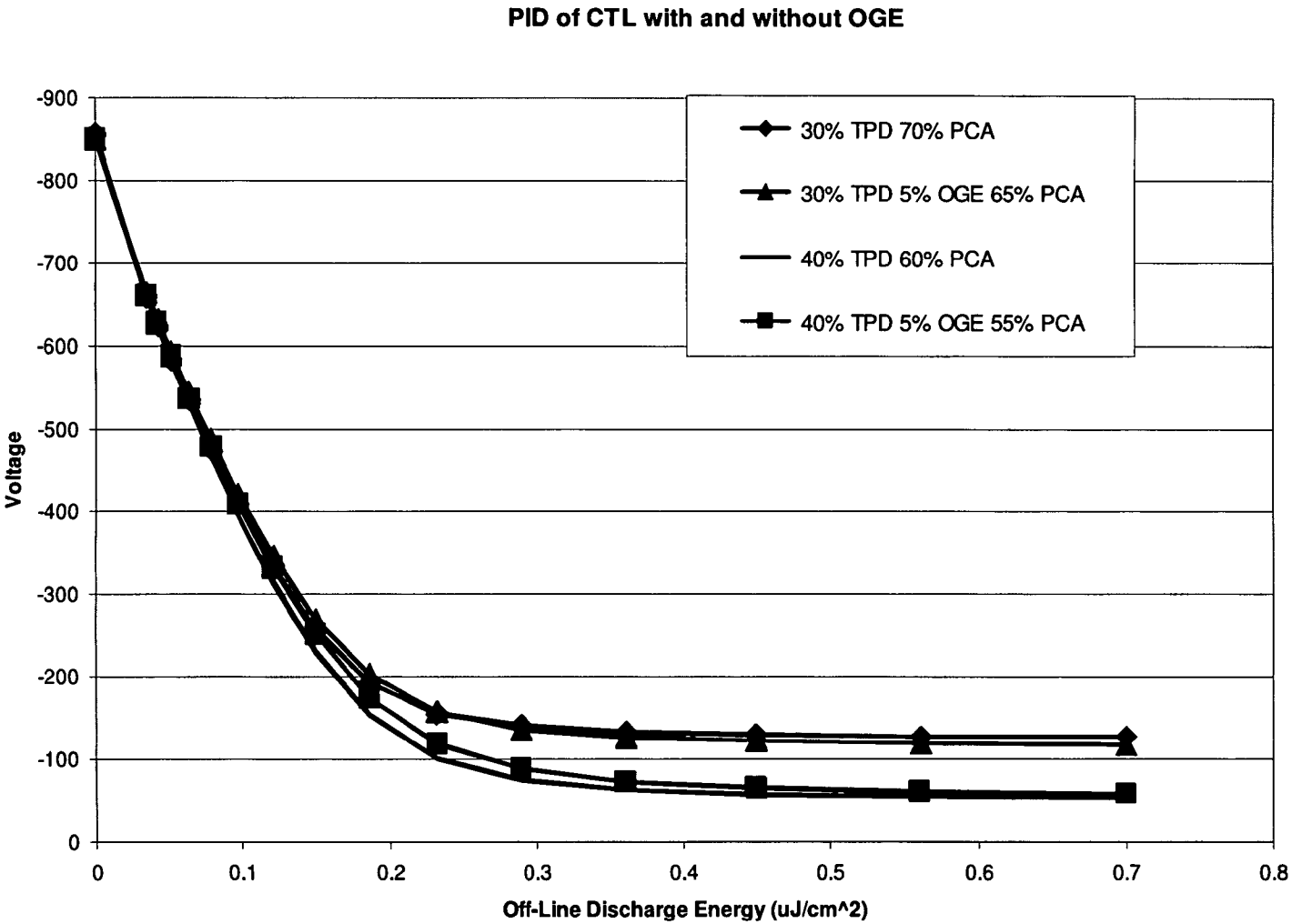
FIG. 2 is a graphical illustration comparing the photo-induced decay of photoconductor having charge transport layers with and without OGE according to one or more embodiments of the present invention; and, FIG. 3 is a graphical illustration comparing the photo-induced decay of photoconductor having charge transport layers with and without DGE according to one or more embodiments of the present invention.
Figure 3:
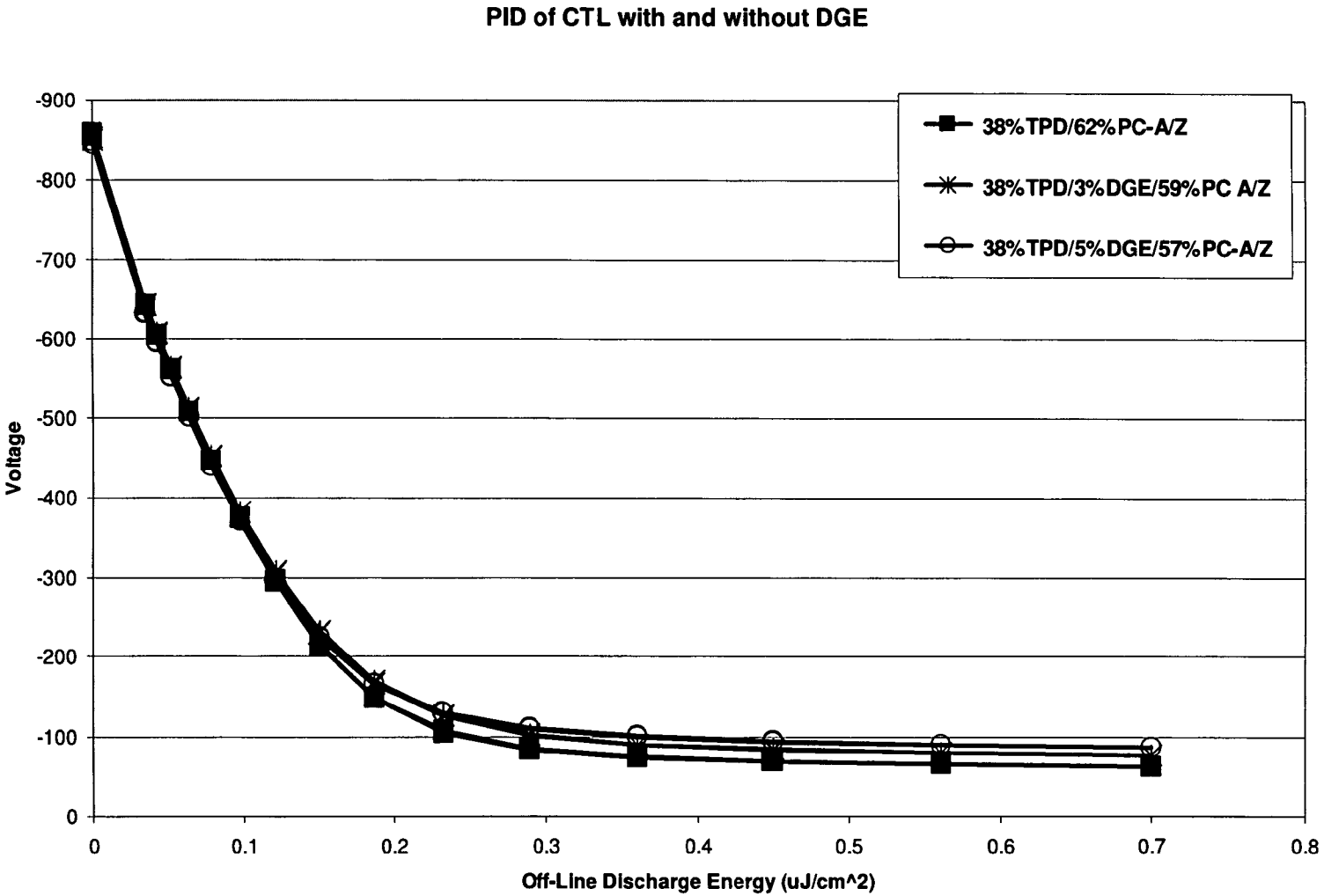

Referring to FIGS. 2 and 3, photo-induced decay (PID) curves of photoconductors with CTL containing TPD with and without OGE and DGE, respectively, are shown. As shown in FIG. 2, the addition of small amounts of OGE has little effect on the shape of the PID curve of a photoconductor, regardless of the TPD loading level. Referring to FIG. 3, similar to OGE, DGE has little effect on the shape of the PID curve of a photoconductor, regardless of the TPD loading level. Consequently, FIGS. 2 and 3 demonstrate that OGE and DGE maintain the electrical and physical properties of the CTL.

In addition to maintaining the performance of the CTL, the results of Tables 4 and 5 demonstrate that DGE and OGE eliminates crazing and crystallization in the CTL. Table 4, provided below, summarizes the crazing test results of TPD formulations with and without OGE. When the drums containing 30% TPD and no OGE in the CTL were fingerprinted and stored in the lab for an extended period of time, crystallization of the CTL became visible in the fingerprinted areas (no crazing in this instance). However, neither crystallization nor crazing was observed in the drums containing 30% TPD and 5% of OGE. Moreover, with a 40% loading of TPD, crazing was observed on the drums without OGE; however the addition of OGE prevented the occurrence of crystallization and CTL crazing in photoconductors containing 40% TPD.

TABLE 4

Crazing Test of photoconductors containing TPD or TPD/OGE

| TPD/OGE/PCA into 60° C. oven | | | ELAPSED TIME h = hours, d = days | | | | | | | | | | |
|---|---|---|---|---|---|---|---|---|---|---|---|---|---|
| Drum Composition | Drum | Test | 2 h | 6 h | 24 h | 4 d | 5 d | 6 d | 7 d | 8 d | 12 d | 14 d | >14 d @ ambient |
| 30% TPD | 1 | ThumbPrint | N | N | N but | many | | | | | | | |
| 0% OGE | | (TP) | | | crystals | crystals | | | | | | | |
| 70% PC-A | | Lotion (L) | Y–widespread | | | | | | | | | | |
| | 2 | TP | N | N | N but | many | | | | | | | |
| | | | | | crystals | crystals | | | | | | | |
| | | L | Y–widespread | | | | | | | | | | |
| 30% TPD | 3 | TP | N | N | N | N | N | N | N | N | N | N | N |
| 5% OGE | | L | N | N | N | N | N | N | N | N | N | N | N |
| 65% PC-A | 4 | TP | N | N | N | N | N | N | N | N | N | N | N |
| | | L | N | N | N | N | N | N | N | N | N | N | N |
| 40% TPD | 5 | TP | N | | | craze; | | | | | | | |
| 0% OGE | | | | | | no | | | | | | | |
| 60% PC-A | | | | | | crystals | | | | | | | |
| | | L | Y | | | | | | | | | | |
| | 6 | TP | N | | | craze; | | | | | | | |
| | | | | | | no | | | | | | | |
| | | | | | | crystals | | | | | | | |
| | | L | Y | | | | | | | | | | |
| 40% TPD | 7 | TP | N | N | N | N | N | N | N | N | N | N | N |
| 5% OGE | | L | N | N | N | N | N | N | N | N | N | N | N |
| 55% PC-A | 8 | TP | N | N | N | N | N | N | N | N | N | N | N |
| | | L | N | N | N | N | N | N | N | N | N | N | N |

In Table 5 the crazing test results of TPD formulations with and without DGE indicate that DGE improves crazing resistance of TPD formulations like OGE (see Table 4).

TABLE 5

Crazing Test of photoconductors containing TPD or TPD/DGE

| into 60° C. oven | | ELAPSED TIME h = hours, d = days | | | | | | | | | |
|---|---|---|---|---|---|---|---|---|---|---|---|
| Drum Composition | Test | 2 h | 24 h | 2 d | 5 d | 6 d | 7 d | 9 d | 12 d | 14 d | +14 d @ ambient |
| 38% TPD in PC-A/Z | ThumbPrint | | | Y | | | | | | | |
| | Lotion | Y | | | | | | | | | |

TABLE 5-continued

| Crazing Test of photoconductors containing TPD or TPD/DGE | | | | | | | | | | | |
|---|---|---|---|---|---|---|---|---|---|---|---|
| into 60° C. oven | | ELAPSED TIME h = hours, d = days | | | | | | | | | |
| Drum Composition | Test | 2 h | 24 h | 2 d | 5 d | 6 d | 7 d | 9 d | 12 d | 14 d | +14 d @ ambient |
| 38% TPD in PC-A/Z | TP | | Y | | | | | | | | |
| | L | Y | | | | | | | | | |
| 38% TPD/ | TP | | | | | | | | | N | N |
| 3% DGE in PC-A/Z | L | | | | | | | | | N | N |
| 38% TPD/ | TP | | | | | | | | | N | N |
| 3% DGE in PC-A/Z | L | | | | | | | | | N | N |
| 38% TPD/ | TP | | | | | | | | | N | N |
| 5% DGE in PC-A/Z* | L | | | | | | | | | N | N |
| 38% TPD/ | TP | | | | | | | | | N | N |
| 5% DGE in PC-A/Z* | L | | | | | | | | | N | N |
| 30% TPD in PC-A | TP | | Y | Y+ crystals | | | | | | | |
| | L | Y | | | | | | | | | |
| 30% TPD in PC-A | TP | | Y | Y+ crystals | | | | | | | |
| | L | Y | | | | | | | | | |
| 30% TPD/5% | TP | | | | | | | | | N | N |
| DGE in PC-A | L | | | | | | | | | N | N |
| 30% TPD/5% | TP | | | | | | | | | N | N |
| DGE in PC-A | L | | | | | | | | | N | N |
| 40% TPD in PC-A | TP | | | | | | | Y | | | |
| | L | Y | | | | | | | | | |
| 40% TPD in PC-A | TP | | | | | | | Y | | | |
| | L | Y | | | | | | | | | |
| 40% TPD/5% | TP | | | | | | | | | N | N |
| DGE in PC-A | L | | | | | | | | | N | N |
| 40% TPD/5% | TP | | | | | | | | | N | N |
| DGE in PC-A | L | | | | | | | | | N | N |

PC-A/Z: 75% PC-A and 25% PC-Z

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A photoconductor comprising:

an electrically conductive substrate;

a charge generation layer disposed over the electrically conductive substrate; and a charge transport layer disposed over the charge generation layer, wherein the charge transport layer comprises charge transport molecules and dodecyl/tetradecyl glycidyl ether (DGE).

2. The photoconductor of claim 1 wherein the charge transport molecule is N,N'-bis (3-methylphenyl)-N,N'-diphenylbenzidine (TPD).

3. The photoconductor of claim 1 wherein the charge transport layer further comprises polycarbonate, polysiloxane, or combinations thereof.

4. The photoconductor of claim 1 wherein the charge transport layer further comprises organic solvents selected from the group consisting of tetrahydrofuran and 1,4-dioxane.

5. The photoconductor of claim 1 wherein the charge transport layer comprises about 30 to about 40% by wt. N,N'-bis (3-methylphenyl)-N,N'-diphenylbenzidine (TPD), and about 3 to about 5% by wt. DGE.

6. The photoconductor of claim 1 wherein the charge transport layer comprises a thickness of between about 20 to about 30 μm.

7. The photoconductor of claim 1 wherein the charge generation layer comprises titanyl phthalocyanine dispersed in a binder.

8. The photoconductor of claim 7 wherein the binder comprises polyvinylbutyral, poly(methyl-phenyl)siloxane, polyhydroxystyrene, or combinations thereof.

9. The photoconductor of claim 1 wherein the charge generation layer comprises organic solvents selected from the group consisting of 2-butanone and cyclohexanone.

10. The photoconductor of claim 1 wherein the charge generation layer comprises a thickness of about 0.1 to about 1 μm.

11. The photoconductor of claim 1 wherein the charge generation layer comprises a thickness of about 0.2 to about 0.3 μm.

12. The photoconductor of claim 1 wherein the electrically conductive substrate is an anodized and sealed aluminum core.

13. A printer cartridge comprising the photoconductor of claim 1.

14. A printer comprising the photoconductor of claim 1.

15. The photoconductor of claim 1 wherein the charge transport layer further comprises octyl/decyl glycidyl ether (OGE).

* * * * *